United States Patent [19]

Ishida et al.

[11] Patent Number: 4,590,894

[45] Date of Patent: May 27, 1986

[54] COOLANT PASSAGE SYSTEM OF INTERNAL COMBUSTION ENGINE

[75] Inventors: Yoshiyuki Ishida, Tokyo; Yosio Taguchi, Yokohama, both of Japan

[73] Assignee: Nissan Motor Co., Ltd., Yokohama, Japan

[21] Appl. No.: 713,091

[22] Filed: Mar. 18, 1985

Related U.S. Application Data

[63] Continuation of Ser. No. 639,356, Aug. 10, 1984, abandoned.

[30] Foreign Application Priority Data

Aug. 18, 1983 [JP] Japan ..... 58-151013

[51] Int. Cl.[4] ..... F02F 1/10

[52] U.S. Cl. ..... 123/41.74

[58] Field of Search ..... 123/193 C, 41.72, 41.74, 123/41.79, 41.81, 41.82

[56] References Cited

U.S. PATENT DOCUMENTS

| | | | |
|---|---|---|---|
| 1,711,781 | 5/1929 | Gibson | 123/41.72 |
| 2,713,332 | 7/1955 | Beardsley | 123/41.74 |
| 4,284,037 | 8/1981 | Kasting | 123/41.72 |

FOREIGN PATENT DOCUMENTS

| | | | |
|---|---|---|---|
| 2555942 | 6/1977 | Fed. Rep. of Germany | 123/41.72 |
| 54-13443 | 6/1979 | Japan . | |
| 768146 | 2/1957 | United Kingdom . | |
| 851049 | 10/1960 | United Kingdom . | |

*Primary Examiner*—Ronald H. Lazarus

*Attorney, Agent, or Firm*—Schwartz, Jeffery, Schwaab, Mack, Blumenthal & Evans

[57] ABSTRACT

In an internal combustion engine comprising a cylinder block having at least one row of cylinders and at least one cylinder head, there are provided a coolant distributor passage for supplying a coolant from a pump to the water jacket of the cylinder block, first and second communication holes for allowing the coolant to flow from the cylinder block water jacket to the cylinder head water jacket, and a coolant collector passage for returning the coolant from the cylinder head water jacket to the pump. The coolant distributor passage and collector passages both extend along the cylinder row, one on one side of the cylinder row and the other on the opposite side. The distributor passage is formed in an upper portion of the cylinder block near the cylinder head. The collector passage is formed in the cylinder head. One longitudinal end of the collector passage is connected to the pump. The first communication holes are formed on the distributor passage's side and the second communication holes on the collector passage's side. The first and second communication holes are so sized that the total opening area of the first communication holes are larger than that of the second holes.

9 Claims, 4 Drawing Figures

COOLANT PASSAGE SYSTEM OF INTERNAL COMBUSTION ENGINE

This application is a continuation of application Ser. No. 639,356, filed 08/10/84 now abandoned.

BACKGROUND OF THE INVENTION

The present invention relates to an internal combustion engine having a system of coolant passages formed in or around a cylinder block and a cylinder head.

One example of the coolant passage system is shown in Japanese Utility Model examined publication No. 13443/1979. In this example, there is formed, in an upper portion of a cylinder block, a coolant distributor passage extending along a row of cylinders. The coolant distributor passage serves to supply the cooling water to the vicinities of all the cylinders simultaneously so that all the cylinders can be cooled equally. However, the coolant collector passage is not sufficient to cool the row of cylinders uniformly because there is a tendency for the cooling water to flow longitudinally along the cylinder row in the water jacket of the cylinder head.

SUMMARY OF THE INVENTION

It is an object of the present invention to provide an internal combustion engine having a coolant passage system designed to cool all the cylinders in a cylinder row uniformly.

According to the present invention, an internal combustion engine comprises a cylinder block and a cylinder head.

The cylinder block comprises a row of cylinders, a cylinder block water jacket, a coolant distributor passage which extends along the cylinder row on a first side of the cylinder row in proximity to a top of said cylinder block and which is fluidly connected with said cylinder block water jacket for supplying a coolant to said cylinder block jacket, a first side portion defining a plurality of first communication holes lying on the first side of the cylinder row, and a second side portion defining a plurality of second communication holes lying on a second side of the cylinder row opposite to the first side. The cylinder head is mounted on the top of said cylinder block for the cylinder row. The cylinder head comprises a cylinder head water jacket, a coolant collector passage which extends along the cylinder row on the second side, and is fluidly connected with said cylinder head water jacket for allowing the coolant to go out from said cylinder head jacket, a first side portion defining said first communication holes together with said first side portion of said cylinder block, and a second side portion defining said second communication holes together with said second side portion of said cylinder block. The first and second communication holes make a fluid communication between said cylinder block water jacket and said cylinder head water jacket. The first and second communication holes are so sized that the total opening area of said first communication holes is greater than the total opening area of said second communication holes.

DETAILED DESCRIPTION OF THE INVENTION

Figure 1:
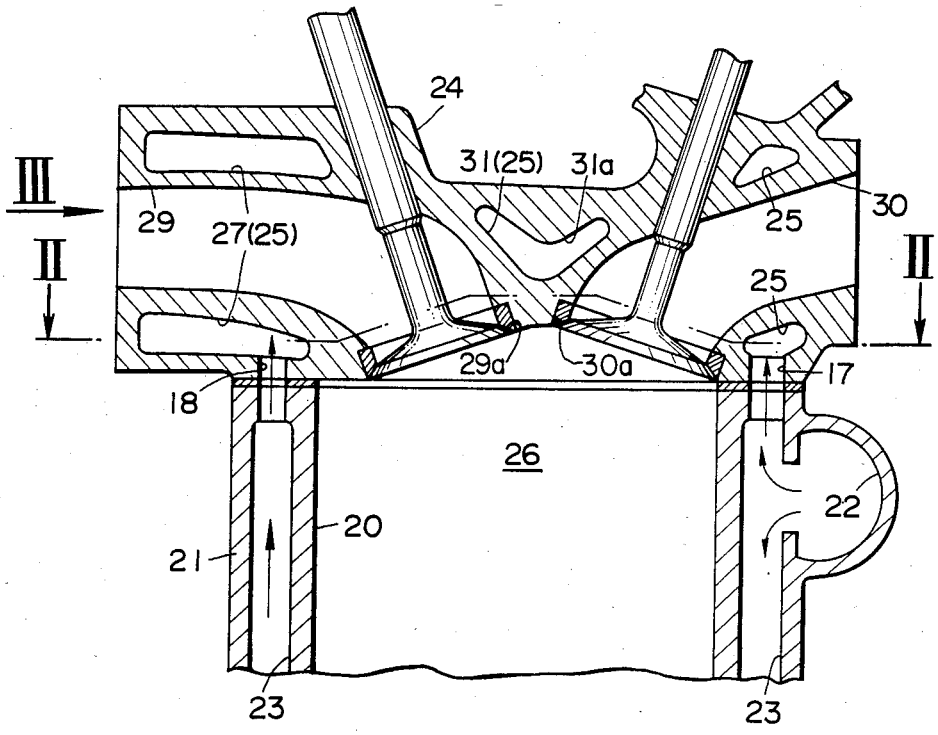
FIG. 1 is a sectional view of a portion of an internal combustion engine, showing one embodiment of the present invention.
Figure 2:
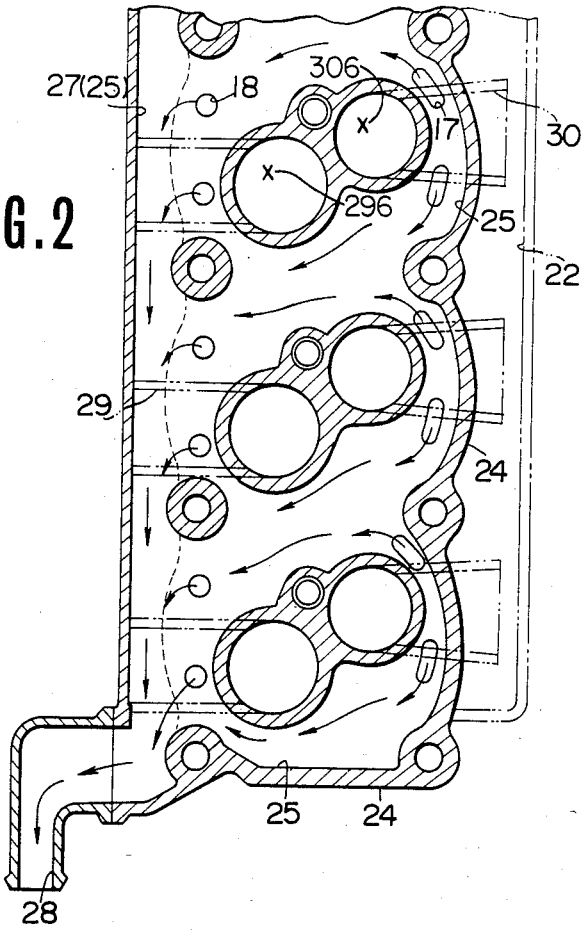
FIG. 2 is a sectional view taken along a line II—II of FIG. 1.
Figure 3:
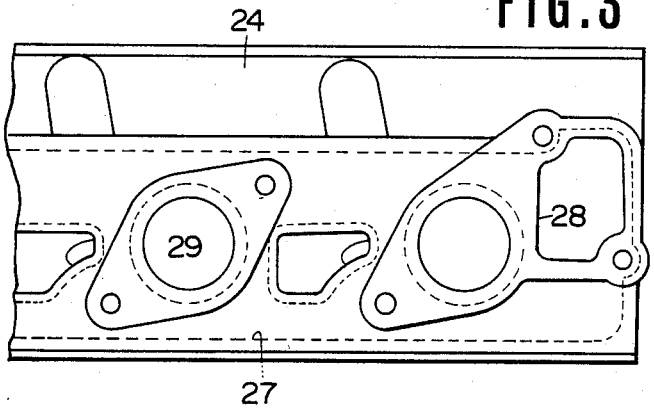
FIG. 3 is a view in the direction shown by an arrow III of FIG. 1.
Figure 4:
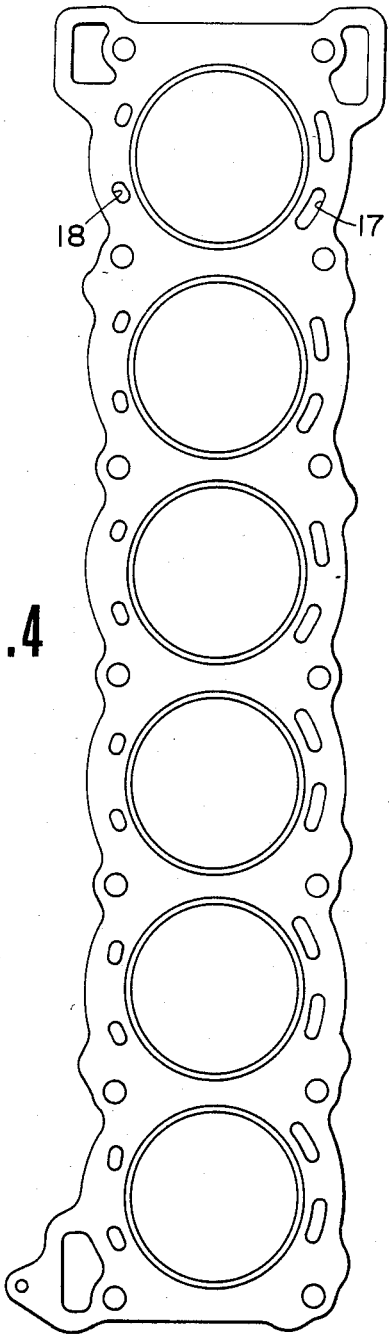
FIG. 4 is a plan view of a head gasket formed with large first communication holes for a coolant on one side of a cylinder row and small second communication holes for the coolant on the other side.

One embodiment of the present invention is shown in FIGS. 1–4. As shown in FIG. 1, a coolant distributor passage 22 is formed in an upper portion of a cylinder block 21 on one side (a right side as viewed in FIG. 1), which is referred to as a first side, hereinafter. The distributor passage 22 extends along a row of cylinders substantially over the full longitudinal length of the cylinder row. The cylinder block 21 is formed with cylinders 20 and a water jacket 23 surrounding the cylinders 20. The water jacket 23 is in a fluid communication with the distributor passage 22. The distributor passage 22 stores a cooling water discharged from a water pump (not shown) and supplies the cooling water to the water jacket 23. A cylinder head 24 is mounted on a top of the cylinder block 21. The cylinder head 24 forms therein combustion chambers 26 with the cylinders 20 of the cylinder block 21. Intake ports 29 for supplying air to the combustion chambers 26 are formed in the cylinder head 24 on a second side opposite to the distributor passage's first side. Exhaust ports 30 for discharging exhaust gases from the combustion chambers 26 are formed in the cylinder head 24 on the distributor passage's first side. The cylinder head 24 is further formed with a water jacket 25 surrounding each of the combustion chambers 26, the intake ports 29 and the exhaust ports 30. The intake and exhaust ports have inner ends **29*a* and 30*a*, respectively, which open into the combustion chamber 26. The water jacket 25 of the cylinder head 24 is in communication with the water jacket 23 of the cylinder block 21 through a plurality of first communication holes 17 on the first side, and a plurality of second communication holes 18 on the second side. As shown in FIG. 2, the opening area of each of the first communication holes 17 of the first side is greater than the opening area of each of the communication holes 18** of the second side.

As shown in FIG. 1, the water jacket 25 has central passages 31, each of which extends along the direction of cylinder row between a pair of the intake port 29 and the exhaust port 30. Each of the central passages 31 is narrowed by a downwardly projecting portion **31*a* and V-shaped in cross section. The opening area of each of the central passages 31 is greater than the opening area of each of the first communication holes 17**.

The cylinder head 24 is further formed with a coolant collector passage 27 on the second side opposite to the distributor passage's side. The collector passage 27 extends along the cylinder row substantially over the full longitudinal length of the cylinder row on the second side. As shown in FIG. 2, the collector passage 27 is in fluid communication with the water jacket 25 of the cylinder head 24. A water outlet 28 is formed in one longitudinal end of the collector passage 27. The outlet 28 of the collector passage 27 is connected to the water pump (not shown) so that the cooling water discharged from the water jacket 25 of the cylinder head 24 returns through the outlet 28 to the water pump.

In the thus designed engine, the cooling water discharged from the pump first flows into the distributor passage 22. The water is stored in the distributor passage 22 and then supplied to the water jacket 23 of the cylinder block 21. The distributor passage 22 can supply the cooling water to the vicinity of each cylinder evenly approximately at the same time, so that the temperature gradient in the direction of the cylinder row can be reduced and the temperature distribution in the direction of the cylinder row can be made uniform. The cooling water in the water jacket 23 of the cylinder block 21 flows through the communication holes 17 and 18 to the water jacket 25 of the cylinder head 24 by virtue of the fluid pressure. The amount of the cooling water supplied to the water jacket 25 of the cylinder head 24 through the first communication holes 17 is much greater than the amount of the water supplied through the second communication holes 18, because the size of the first communication holes 17 are larger than the size of the second communication holes 18. Accordingly, the most of the water supplied to the water jacket 23 of the cylinder block 21 flows into the water jacket 25 of the cylinder head 24 through the first communication holes 17. The rest of the water flows around the cylinders 20 to cool them and then flows through the second communication holes 18 into the water jacket 25 of the cylinder head 24. In the water jacket 25 of the cylinder head 24, the flow of the cooling water through the central passages 31 is limited by the projecting portions 31*a*. Because of the size difference between the first and second communication holes 17 and 18, and the narrowed central passages 31, there arises naturally a tendency for the cooling water to flow from the distributor passage's first side to the collector passage's second side, as shown by arrows in FIG. 2. Thus, the cooling water flows approximately in the direction perpendicular to the direction of the cylinder row, cools all the cylinders simultaneously, and reaches the collector passage 27 approximately at the same time. In the embodiment of FIG. 2, the flow of cooling water is around the inner ends 29*a*, 30*a* of the intake and exhaust ports, that is, the flow is parallel to a line joining the centers 29*b*30*c* of the inner ends 29*a*,30*b*. After that, the cooling water goes out through the outlet 28 toward the water pump. The cooling water thus flowing in the water jacket 25 of the cylinder head 24 from the distributor passage's first side to the collector passage's second side can prevent occurrence of temperature gradient in the direction of the cylinder row in the cylinder head 24, and make the cylinder to cylinder temperature distribution uniform. In an engine of a conventional design, the cooling water tends to flow longitudinally along the cylinder row, and accordingly the cylinder head is cooled nonuniformly along the direction of the cylinder row in such a manner that the temperature is highest at a portion near the downstream endmost cylinder located at a downstream end of the coolant flow along the cylinder row. In general, maximum load conditions of engine rpm, intake air amount, ignition timing etc. are determined by engine temperature. If engine temperature is too high, knocking and other desired conditions will result. In the conventional engine, the maximum load conditions must be determined by the temperature of the downstream endmost cylinder, so that the potentials of other cylinders which are not so heated as the downstream endmost cylinder cannot be fully utilized. In the engine of the present invention, all the cylinders are cooled equally, so that the tendency to knocking is reduced and all the cylinders are efficiently utilized.

In this embodiment of the present invention, the coolant distributor passage 22 and the exhaust ports 30 are formed on the same side of the cylinder row, so that the exhaust ports 30 can be cooled efficiently. Furthermore, the coolant collector passage 27 formed on the same side as the intake ports 29 can cool the combustion chamber walls on the intake port's side more efficiently than in the conventional engine in which the intake port's side is not supplied sufficiently with the cooling water. The second communication holes 18 which are made small in opening size restricts the coolant flow from the water jacket 23 of the cylinder block 21 to the water jacket 25 of the cylinder head 24. Accordingly, the second communication holes 18 serves to prevents the cylinder block 21 from being cooled excessively, so that the friction coefficient between the cylinder and piston is reduced, the fuel economy is improved and the engine output is increased.

Each of the first and second communication holes 17 and 18 consists of a hole formed in the cylinder block 21, a hole formed in the cylinder head 24 and a hole formed in a head gasket disposed between the cylinder block 21 and the cylinder head 24. Therefore, the required dimension of each communication hole can be obtained by dimensioning at least one of the component holes of each communication hole. In this embodiment, the number of the first communication holes 17 is equal to the number of the second communication holes 18. The total opening area of the second communication holes 18 can be made smaller than that of the first communication holes 17 by reducing the size of the second communication holes and/or reducing the number of the second communication holes 18. Due to the projecting portions 31*a* reducing the size of the central passages 31, the cooling water flows efficiently from the coolant distributor passage 22 to the coolant collector passage 27.

What is claimed is:

1. An internal combustion engine comprising:

a cylinder block comprising a row of cylinders, a cylinder block water jacket, a coolant distributor passage which extends along the cylinder row on a first side of the cylinder row in proximity to a top of said cylinder block and which is fluidly connected with said cylinder block water jacket for supplying a coolant to said cylinder block jacket, a first side portion defining a plurality of first communication holes lying on the first side of the cylinder row, and a second side portion defining a plurality of second communication holes lying on a second side of the cylinder row opposite to the first side, end a cylinder head mounted on the top of said cylinder block for the cylinder row, said cylinder head comprising a cylinder head water jacket, a coolant collector passage which extends along the cylinder row on the second side, and is fluidly connected with said cylinder head water jacket for allowing the coolant to go out from said cylinder head jacket, a first side portion defining said first communication holes together with said first side portion of said cylinder block, and a second side portion defining said second communication holes together with said second side portion of said cylinder block, said first and second communication holes making a fluid communication between said cylinder block water jacket and said cylinder head water jacket, said first and second communication holes being so sized that the total opening area of said first communication holes is greater than the total opening area of said second communication holes, said cylinder head having at least one intake port and at least one exhaust port associated with each said cylinder, said coolant flowing parallel to a line joining the centers of respective inner ends of said intake and exhaust ports.

2. An engine according to claim 1, wherein said intake ports are formed on the second side of the cylinder row and said exhaust ports are formed on the first side of the cylinder row.

3. An engine according to claim 2, wherein one longitudinal end of said coolant collector passage is closed, and the other longitudinal end is opened as a coolant outlet.

4. An internal combustion engine, comprising:

a cylinder block comprising a row of cylinders, a cylinder block water jacket, a coolant distributor passage which extends along the cylinder row on a first side of the cylinder row in proximity to a top of said cylinder block and which fluidly connected with said cylinder block water jacket for supplying a coolant to said cylinder block jacket, a first side portion defining a plurality of first communication holes lying on the first side of the cylinder row, and a second side portion defining a plurality of second communication holes lying on a second side of the cylinder row opposite to the first side, and a cylinder head mounted on the top of said cylinder block for the cylinder row, said cylinder head formed with intake ports on the second side of the cylinder row and exhaust ports on the first side of the cylinder row and comprising a cylinder head water jacket, a coolant collector passage which extends along the cylinder row on the second side and having one longitudinal end closed and another longitudinal end opened as a coolant outlet, said passage being fluidly connected with said cylinder head water jacket for allowing the coolant to go out from said cylinder head jacket, a first side portion defining said first communication holes together with said first side portion of said cylinder block, and a second side portion defining said second communication holes together with said second side portion of said cylinder block, said first and second communication holes making a fluid communication between said cylinder block water jacket and said cylinder head water jacket, said first and second communication holes being so sized that the tool opening area of said first communication holes is greater than the total opening area of said second communication holes;

wherein said cylinder head is further formed with a plurality of central passages each of which extends longitudinally along the cylinder row between one pair of the intake and exhaust ports and, has such a cross sectional area as to restrict the coolant passage therethrough.

5. An engine according to claim 4, wherein the cross section of each of said central passages is V-shaped.

6. An engine according to claim 5, further comprising a head gasket disposed between said cylinder block and said cylinder head, said head gasket comprising a first side portion defining said first communication holes together with said first side portions of said cylinder block and said cylinder head, and a second side portion defining said second communication holes together with said second side portions of said cylinder block and said cylinder head.

7. An engine according to claim 1, wherein said intake and exhaust ports are grouped so that each cylinder has a group of said intake and exhaust ports, and wherein said cylinder head water jacket comprises a main cavity which surrounds each group of said intake and exhaust ports in a manner to prevent coolant from flowing between the intake and exhaust ports associated with the same cylinder, and extends from said first communication holes on the first side of the cylinder row to the second side of the cylinder row substantially in parallel to a first plane perpendicular to the axes of said cylinders so as to enable the coolant to flow freely across the cylinder row from each of said first communication holes to the second side of the cylinder row substantially in parallel to said first plane.

8. An engine according to claim 7, wherein each of said exhaust ports has an inner end which opens into one of said combustion chambers of the cylinder row and whose center lies on the first side of a second plane containing the axes of said cylinders, and extends from said inner end to the first side of the cylinder row, and each of said intake ports has an inner end which opens into one of said combustion chambers and whose center lies on the second side of said second plane, and extends from said inner end to the second side of the cylinder row.

9. An engine according to claim 8, wherein at least two of said first communication holes are formed around each of said exhaust ports so that the coolant can flow on both sides of each exhaust port from the first side of the cylinder row to the second side.

* * * * *